US010468821B2

(12) United States Patent
Hirota

(10) Patent No.: US 10,468,821 B2
(45) Date of Patent: Nov. 5, 2019

(54) LEVER-TYPE CONNECTOR

(71) Applicant: Sumitomo Wiring Systems, Ltd., Yokkaichi, Mie (JP)

(72) Inventor: Masanori Hirota, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/950,255

(22) Filed: Apr. 11, 2018

(65) Prior Publication Data

US 2018/0301850 A1 Oct. 18, 2018

(30) Foreign Application Priority Data

Apr. 14, 2017 (JP) ..... 2017-080370

(51) Int. Cl.
*H01R 13/641* (2006.01)
*H01R 13/635* (2006.01)
*H01R 13/629* (2006.01)

(52) U.S. Cl.
CPC ..... *H01R 13/641* (2013.01); *H01R 13/62955* (2013.01); *H01R 13/635* (2013.01); *H01R 13/62938* (2013.01)

(58) Field of Classification Search
CPC ..... H01R 13/629; H01R 13/62938; H01R 13/62955; H01R 13/641
See application file for complete search history.

(56) References Cited

U.S. PATENT DOCUMENTS 5,833,484 A * 11/1998 Post ..... H01R 13/62955 439/352
6,419,507 B2 * 7/2002 Kurimoto ..... H01R 13/62938 439/157
9,407,037 B2 * 8/2016 Kim ..... H01R 13/62938
2003/0109155 A1 * 6/2003 Yamashita ..... H01R 13/62977 439/157
2006/0281351 A1 * 12/2006 Yamaoka ..... H01R 13/62938 439/157
2007/0032107 A1 * 2/2007 Matsubara ..... H01R 13/62955 439/157
2007/0197074 A1 * 8/2007 Gimbel ..... H01R 13/5202 439/213
2010/0151714 A1 * 6/2010 Ambo ..... H01R 13/62955 439/157
2014/0199876 A1 * 7/2014 Kato ..... H01R 13/4538 439/352
2017/0133790 A1 * 5/2017 Yamane ..... H01R 13/703

FOREIGN PATENT DOCUMENTS

JP 2008-41309 2/2008

* cited by examiner

*Primary Examiner* — Amy Cohen Johnson
*Assistant Examiner* — Oscar C Jimenez
(74) *Attorney, Agent, or Firm* — Gerald E. Hespos; Michael J. Porco; Matthew T. Hespos

(57) ABSTRACT

A connector includes a housing (10) connectable to a mating housing (90), a detector (40) arranged movably from a standby position to a detection position with respect to the housing (10). A movement from the standby position to the detection position is restricted by locking portions (47) locking stoppers (33) of the housing (10). A lever (60) arranged displaceably from an initial position to a connection position with respect to the housing (10), the both housings (10, 90) is connected toward the connection position by the lever. The lever (60) includes releasing portions (66) for releasing a locked state by pressing the locking portions (47) when the lever is displaced to the connection position.

3 Claims, 11 Drawing Sheets

LEVER-TYPE CONNECTOR

BACKGROUND

Field of the Invention

The invention relates to a lever-type connector.

Description of the Related Art

Japanese Unexamined Patent Publication No. 2008-41309 discloses an electrical connector with a female housing, a U-shaped lever mounted rotatably on the female housing and a detector mounted slidably on an end part of the lever. The female housing is connected lightly to a mating male housing, and the lever then is rotated. This rotation generates a cam action between the lever and the male housing and causes a connecting operation of the housings to proceed. The housings are connected properly when rotation of the lever is completed. The detector then is pushed. An ability to slide the detector indicates that the housings have been connected properly.

The detector is mounted on the lever in the above case. Thus, a hand of a worker who rotates the lever can easily touch the detector, and the hand may inadvertently move the detector. In contrast, a worker's hand is not likely to contact a detector that is mounted on the housing. However, unless the rotation of the lever is linked directly with the movement of the detector, there is no guarantee that the detector will be moved when the rotation of the lever is completed. Therefore, connection detection becomes unreliable.

The invention aims to provide a lever-type that can improve the reliability of connection detection by preventing an inadvertent movement of a detector.

SUMMARY

The invention is directed to a lever-type connector with a housing connectable to a mating housing. A detector is arranged movably from a standby position to a detection position with respect to the housing. However, a movement to the detection position is restricted by a lock for locking a stopper of the housing at the standby position before the housing is connected properly to the mating housing. A locked state of the lock and the stopper is released to allow the movement to the detection position when the housing is connected properly to the mating housing. A lever is displaceable from an initial position to a connection position with respect to the housing. The housing is engaged with the mating housing at the initial position. The housing and the mating housing are connected by a cam mechanism acting between the lever and the mating housing in the process of displacing the lever from the initial position to the connection position. The lever includes a releasing portion for releasing the locked state by pressing either one of the lock and the stopper when the lever is displaced to the connection position.

The releasing portion of the lever presses the lock or the stopper to release the locked state of both when the lever is displaced to the connection position so that the detector becomes movable from the standby position to the detection position. Thus, the movement of the detector is linked directly with the displacement of the lever and detection reliability of the detector can be improved. Further, the detector is arranged on the housing. Thus, the hand of the worker who displaces the lever will not contact the detector, and the detector will not be moved inadvertently in the process of displacing the lever can be prevented.

The lever may be rotatable from the initial position to the connection position about a shaft of the housing. According to this configuration, the contact of the lever with the detector arranged on the housing is avoided more easily.

The detector may include a recess on an outer surface, and the releasing portion may be inserted into the recess. According to this configuration, the connector can be reduced in height by a depth of the recess.

DETAILED DESCRIPTION

Figure 1:
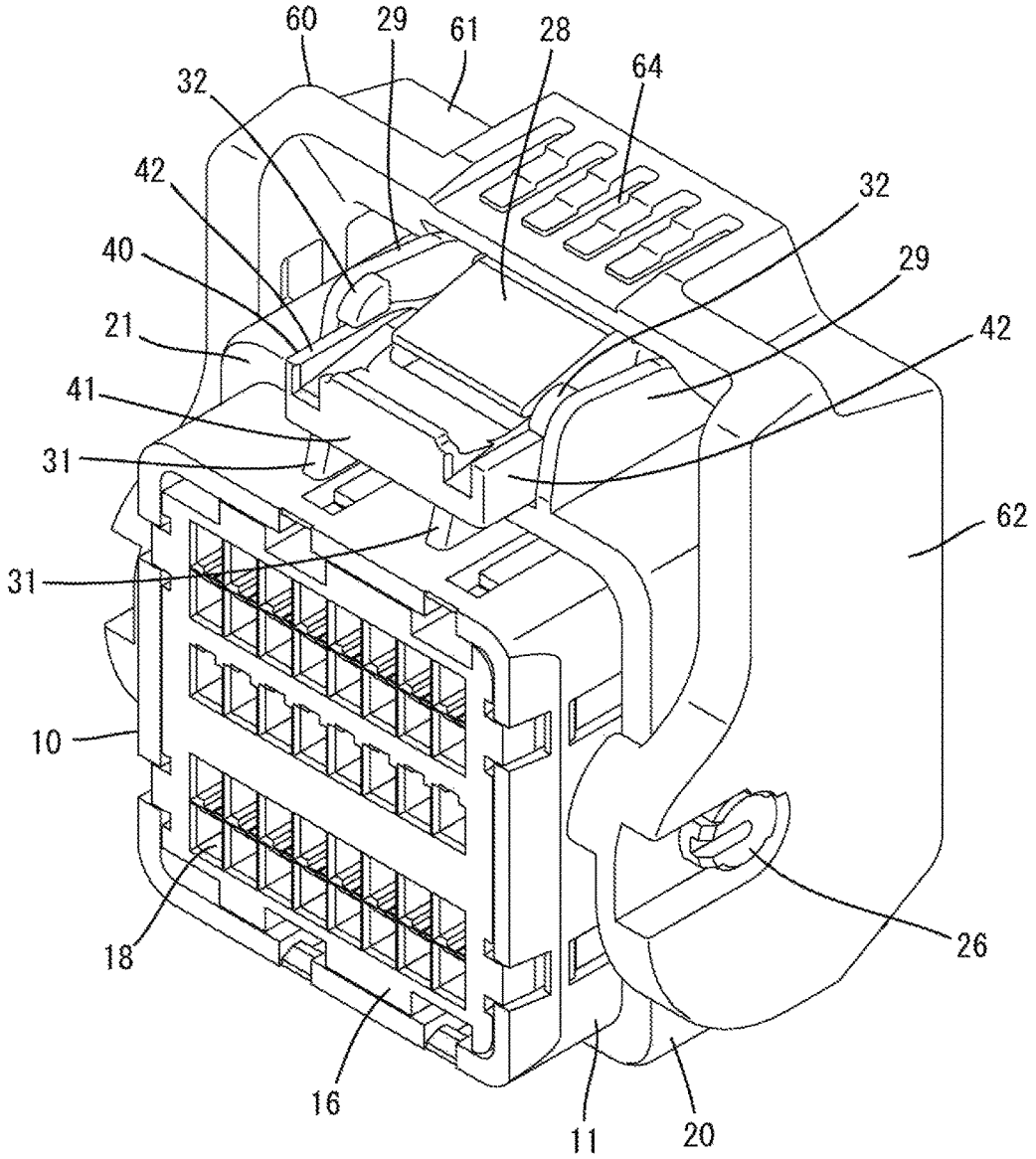
FIG. 1 is a perspective view of a lever-type connector according to an embodiment of the invention and showing a state where a lever is displaced to a connection position and a detector becomes movable to a detection position.

A lever-type connector according to an embodiment of the invention is described with reference to FIGS. 1 to 12. The lever-type connector includes a housing 10, a detector 40 and a lever 60, as shown in FIG. 1. The housing 10 is connectable to a mating housing 90. In the following description, an end of the housing 10 to be connected to the mating housing 90 is referred to as a front concerning a front-rear direction and a vertical direction is based on figures excluding FIGS. 8, 10 and 11.

Figure 2:
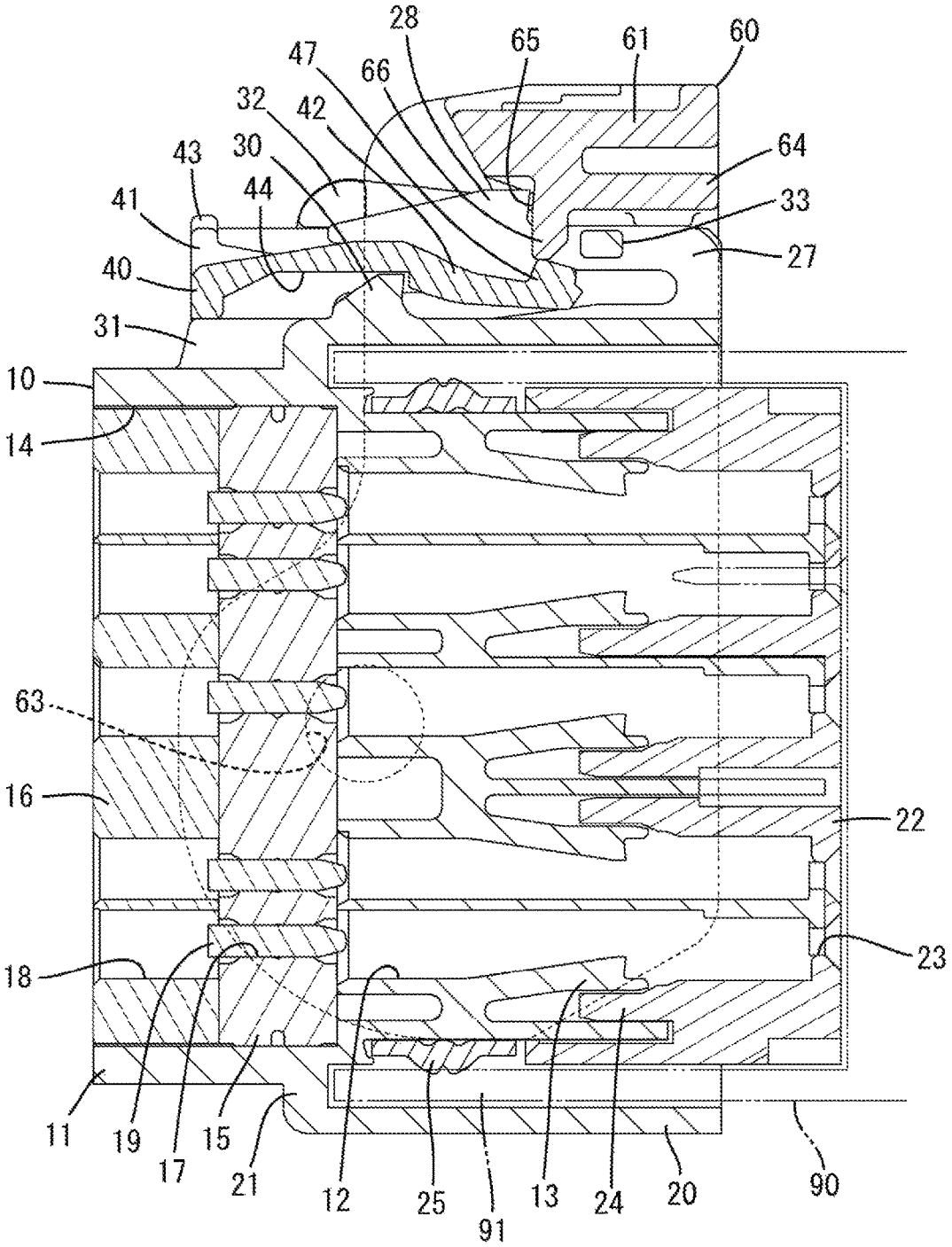
FIG. 2 is a section showing a state where a releasing portion of the lever shown in FIG. 1 is pressing a lock.

The housing 10 is made of synthetic resin and includes a housing body 11 having an outer shape with a substantially rectangular cross-section. As shown in FIG. 2, cavities 12 penetrate through the housing body 11 in the front-rear direction. A female terminal fitting connected to an end part of an unillustrated wire is inserted into each cavity 12 from behind. A locking lance 13 is cantilevered forward at an inner wall of each cavity 12, and the terminal fitting inserted into each cavity 12 is locked by the locking lance 13.

An accommodation recess 14 is open in the rear end of the housing body 11, and the rear end of each cavity 12 is open in the accommodation recess 14. A one-piece rubber plug 15 and, subsequently, a rear holder 16 are inserted into the accommodation recess 14 from behind. The one-piece rubber plug 15 has sealing holes 17, and the rear holder 16 has through holes 18. The one-piece rubber plug 15 is sandwiched in the front-rear direction between the back surface of the accommodation recess 14 and the rear holder 16, and is retained in the housing body 11 by locking the rear holder 16 to the housing body 11. Each sealing hole 17 of the one-piece rubber plug 15 communicates with each cavity 12 and each through hole 18 in the front-rear direction, and the wire is inserted in a liquid-tight manner into the sealing hole 17 when the terminal fitting is inserted into the cavity 12. Further, the one-piece rubber plug 15 closely contacts the peripheral surface of the accommodation recess 14 over the entire periphery. Note that FIG. 2 shows a case where a dummy plug 19 is inserted in each sealing hole 17.

The outer surface of the housing body 11 has an intermediate part excluding both front and rear ends surrounded by a fitting tube 20. The fitting tube 20 is coupled to the housing body 11 via a coupling 21 that projects radially out from the vicinity of the front end of the accommodation recess 14. A connection space is defined forward of the coupling 21 between the fitting tube 20 and the housing body 11 for receiving a receptacle 91 of the partially shown mating housing 90.

Figure 6:
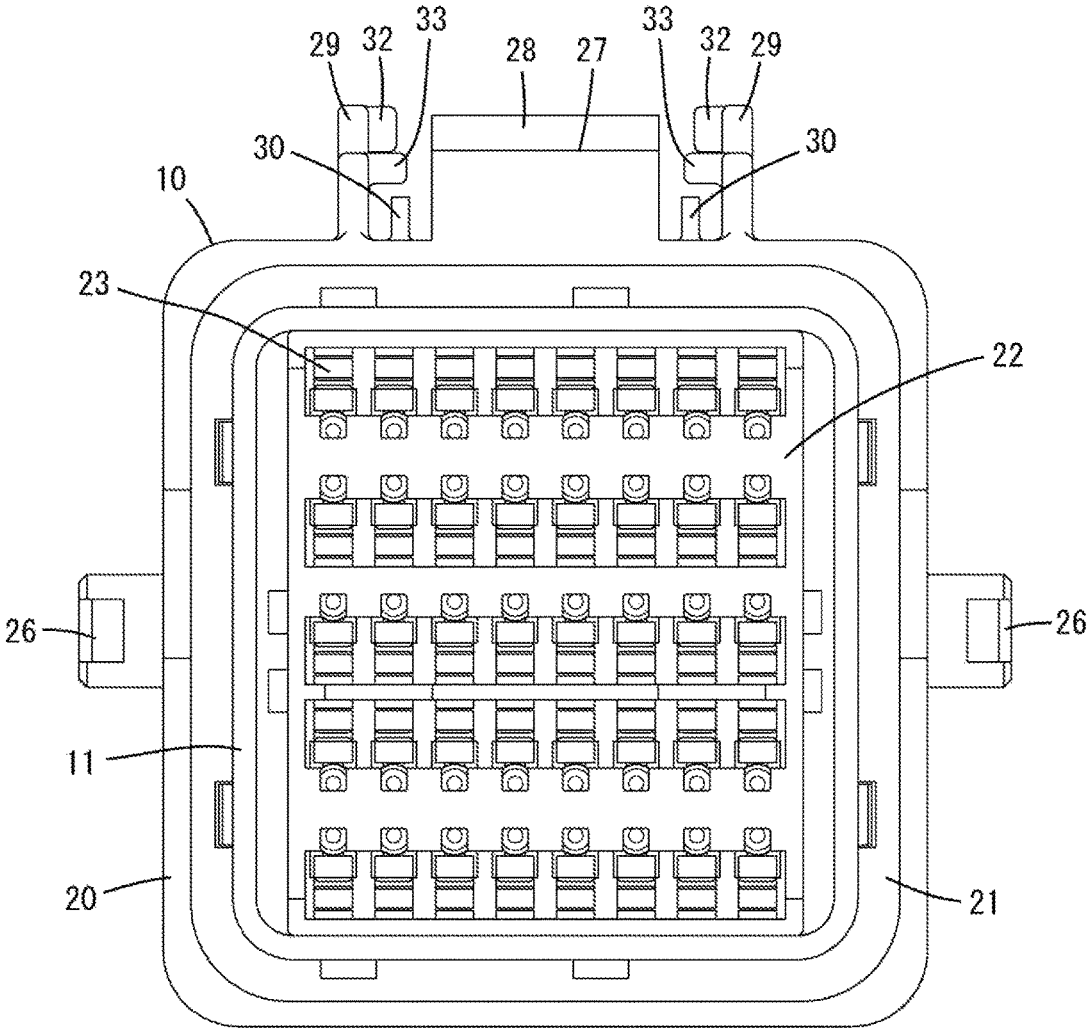
FIG. 6 is a front view of the housing.

As shown in FIGS. 2 and 6, a front part of the housing body 11 is surrounded by a cap-shaped front retainer 22. The front retainer 22 has a front wall that covers the front surface of the housing body 11. The front wall of the front retainer 22 includes tab insertion holes 23 that communicate with the respective cavities 12 in the housing body 11. A male tab of an unillustrated mating terminal fitting mounted in the mating housing 90 is inserted into each tab insertion hole 23 from the front. Further, the front retainer 22 includes entry pieces 24 configured to enter deflection spaces for the respective locking lances 13 when the front retainer 22 is mounted on the housing body 11. The entry pieces 24 restrict deflection of each locking lance 13 and firmly locks the corresponding terminal fitting in a retained state.

A seal ring 25 is fit on the outer surface of the housing body 11, and the front retainer 22 restricts forward detachment of the seal ring 25. The receptacle 91 of the mating housing 90 is fit into the connection space when connecting the housings 10, 90 so that the seal ring 25 is sandwiched resiliently between the receptacle 91 and the housing body 11 to hold the housings 10 and 90 in a liquid-tight manner.

Support shafts 26 project on left and right outer surfaces of the fitting tube 20. Each support shaft 26 is substantially cylindrical and rotatably supports the lever 60.

Figure 5:
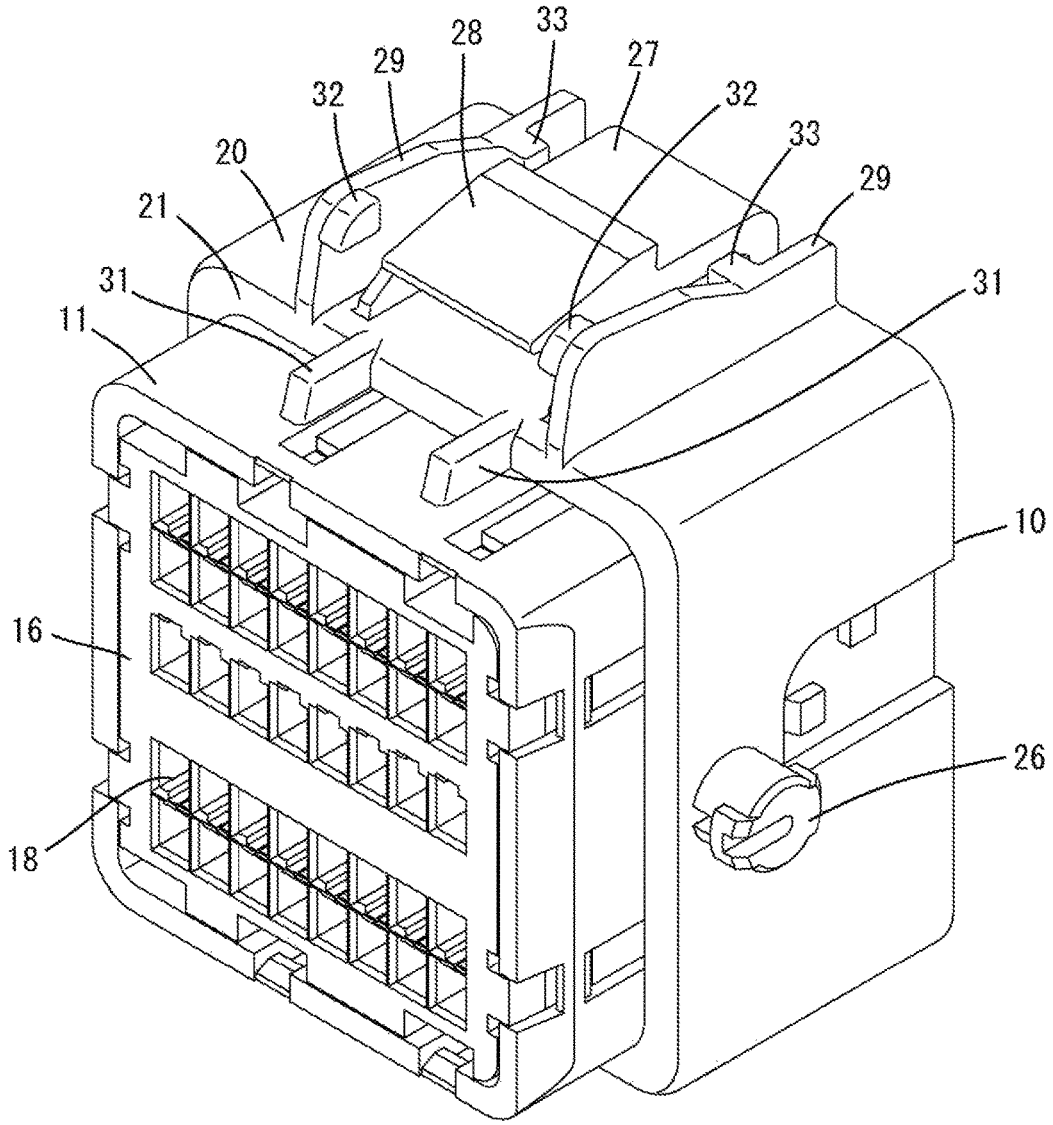
FIG. 5 is a perspective view of the housing.

As shown in FIGS. 5 and 6, a lock arm 27 projects up from the front end of a laterally central part of an upper outer surface of the fitting tube 20 and then is cantilevered rearward. The lock arm 27 is a flat plate having a substantially constant width and includes a thick lock projection 28 in a rear part. The front surface of the lock projection 28 is arranged along a width direction and is locked to a lock 64 of the lever 60 to be described later. The lock projection 28 is thinned gradually toward the rear and the rear surface thereof is sloped down.

Figure 7:
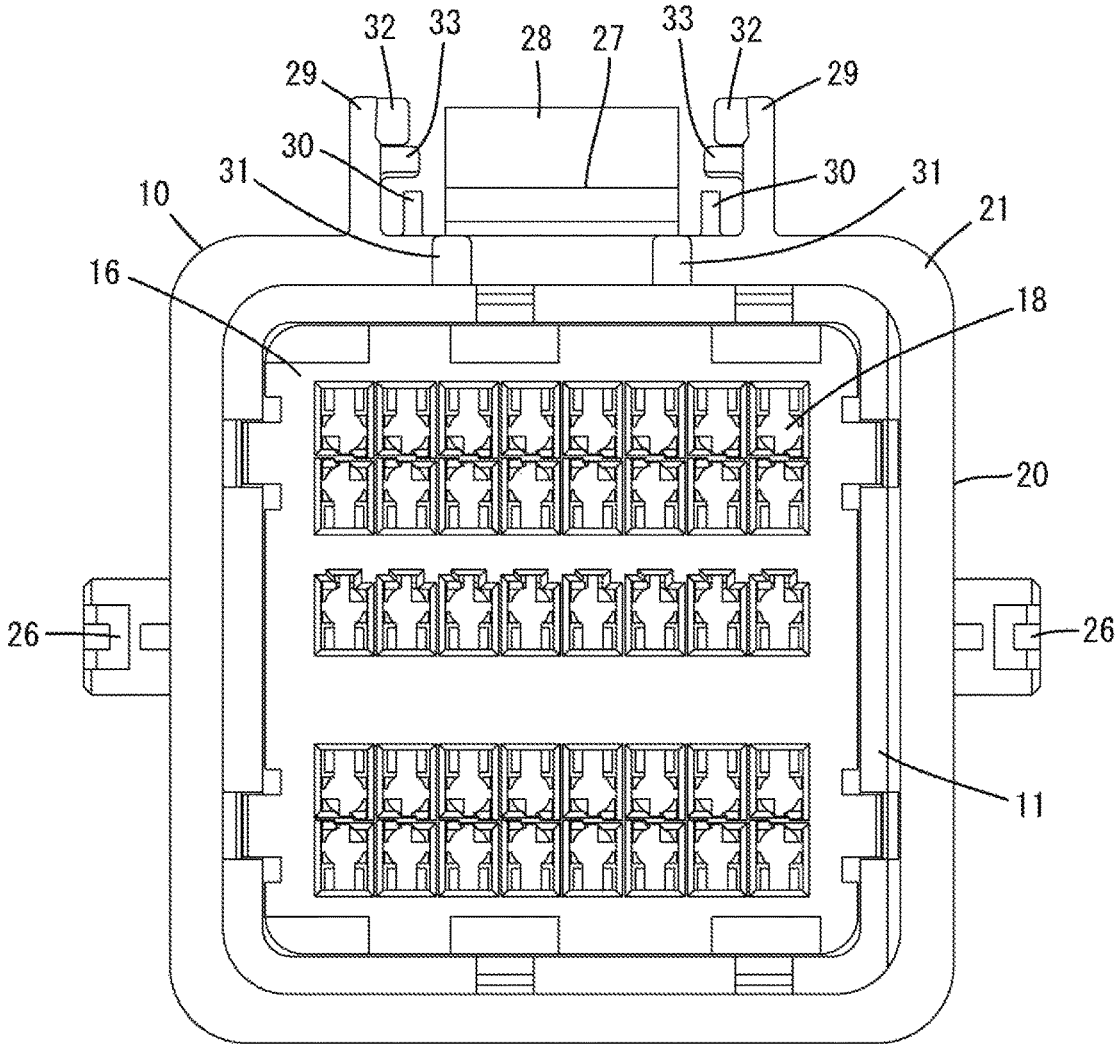
FIG. 7 is a back view of the housing.
Figure 8:
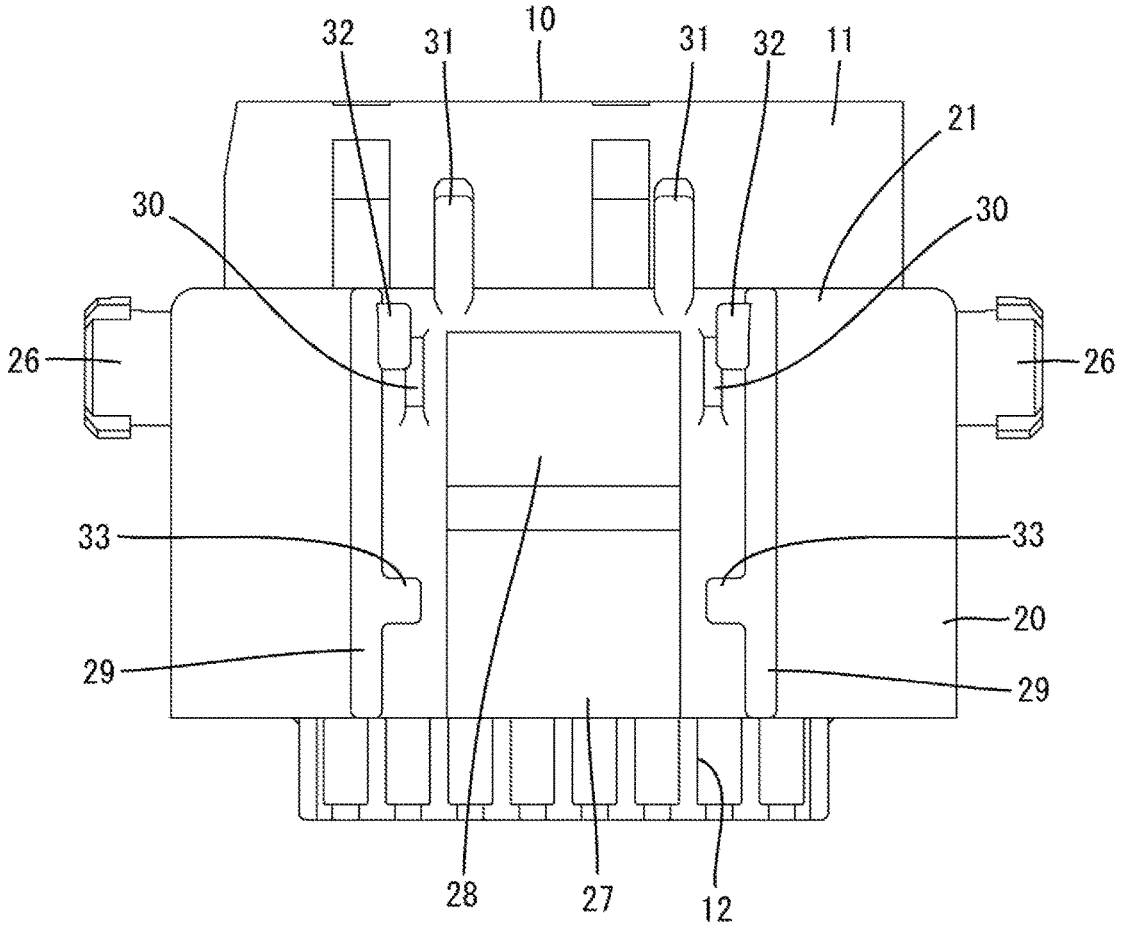
FIG. 8 is a plan view of the housing.

As shown in FIGS. 6 and 7, two protection walls 29 rise on the upper outer surface of the fitting tube 20 at left and right sides of the lock arm 27. As shown in FIG. 8, each protection wall 29 extends along the front-rear direction over the entire length of the upper outer surface of the fitting tube 20. The upper end of each protection wall 29 is lower in a front part than in a rear part to avoid interference with the rotating lever 60. A space between the upper outer surface of the fitting tube 20 and the lock arm 27 and between the protection walls 29 forms a moving space into which the detector 40 is inserted from behind and moved.

Figure 4:
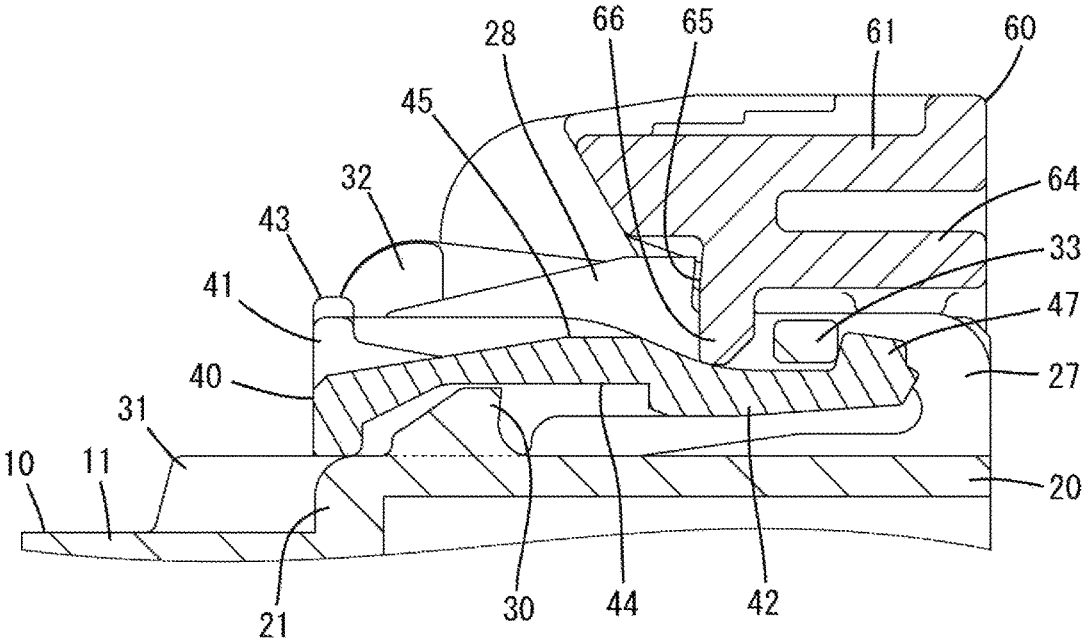
FIG. 4 is an enlarged section showing a state where the detector is moved to the detection position from the state of FIG. 1.

Two guides 30 project at left and right sides of the lock arm 27 and between the respective protection walls 29 on a rear part of the upper outer surface of the fitting tube 20. Each guide 30 is a short rib extending in the front-rear direction and fits into a guide groove 44 of the detector 40 to be slidable, as shown in FIG. 4.

As shown in FIGS. 5 and 8, two supports 31 project at positions behind and inward of the respective guides 30 on the rear outer surface of the housing body 11. Each support 31 is a rib extending in the front-rear direction and is connected to the coupling 21. The upper end of each support 31 is substantially continuous and flush with the upper outer surface of the fitting tube 20, and the support 31 can support a rear part of the detector 40 at a standby position, as shown in FIG. 1.

Further, as shown in FIGS. 5 and 8, two restricting portions 32 are provided on upper ends of rear parts of the respective protection walls 29 and project in toward the moving space. Each restricting portion 32 faces each guide 30 and restricts a lifting of the detector 40 by being held in contact with the upper surface of the detector 40, as shown in FIG. 1.

Two stoppers 33 are provided on upper ends of front parts of the protection walls 29 and project in toward the moving space. Each stopper 33 is a plate that is rectangular in a plan view and is arranged below each guide 30 in the vertical direction. The front and rear surfaces of each stopper 33 are flat along the vertical direction and restrict a movement of the detector 40 by being held in contact with each locking portion 47, as shown in FIG. 4. Note that FIG. 4 shows a state where the locking portion 47 is in contact with the front surface of the stopper 33 to restrict a reward movement of the detector 40 to a standby position, but the locking portion 47 also restricts a forward movement of the detector 40 to a detection position by being held in contact with the rear surface of the stopper 33, as described later.

Figure 10:
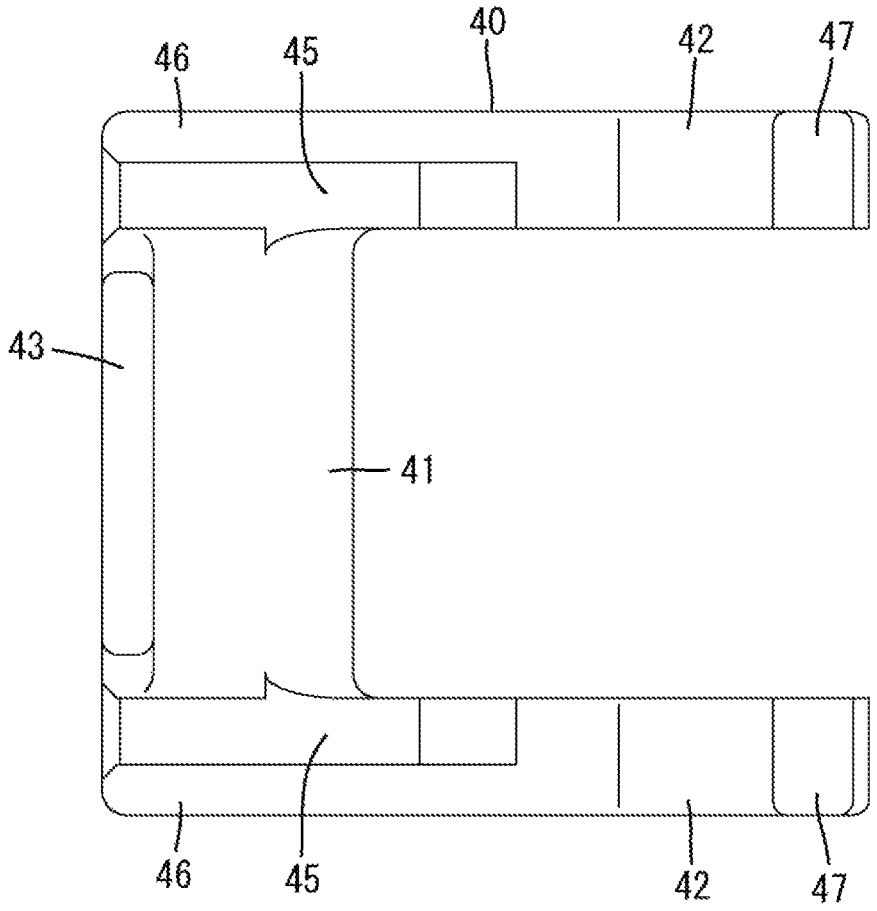
FIG. 10 is a plan view of the detector.

The detector 40 is made of synthetic resin and, as shown in FIG. 10, is substantially U-shaped in a plan view. The detector 40 is composed of an operating portion 41 that extends in the lateral direction, and forwardly projecting arms 42 are connected to left and right ends of the operating portion 41. The operating portion 41 is rectangular in a plan view and a rear end part of the upper surface includes an operating rib 43 extending in the lateral direction for preventing slippage. The detector 40 is movable between the standby position and the operating position. The operating portion 41 is exposed rearward of a rear part of the lock arm 27 when the detector is in the standby position. However, the operating portion 41 is hidden behind the rear part of the lock arm 27 when the detector 40 is in the detection position, and substantially only the operating rib 43 is exposed rearwardly with the detector 40 inserted in the moving space.

Each arm 42 is a substantially rectangular bar extending in the front-rear direction. The lower surface of a rear part of each arm 42 is connected to the lower surface of the operating portion 41 without any step, and the lower surface of a front part thereof is arranged at a position higher than the lower surface of the rear part. Each arm 42 is deflectable and deformable with the rear part coupled to the operating portion 41 as a support.

Figure 11:
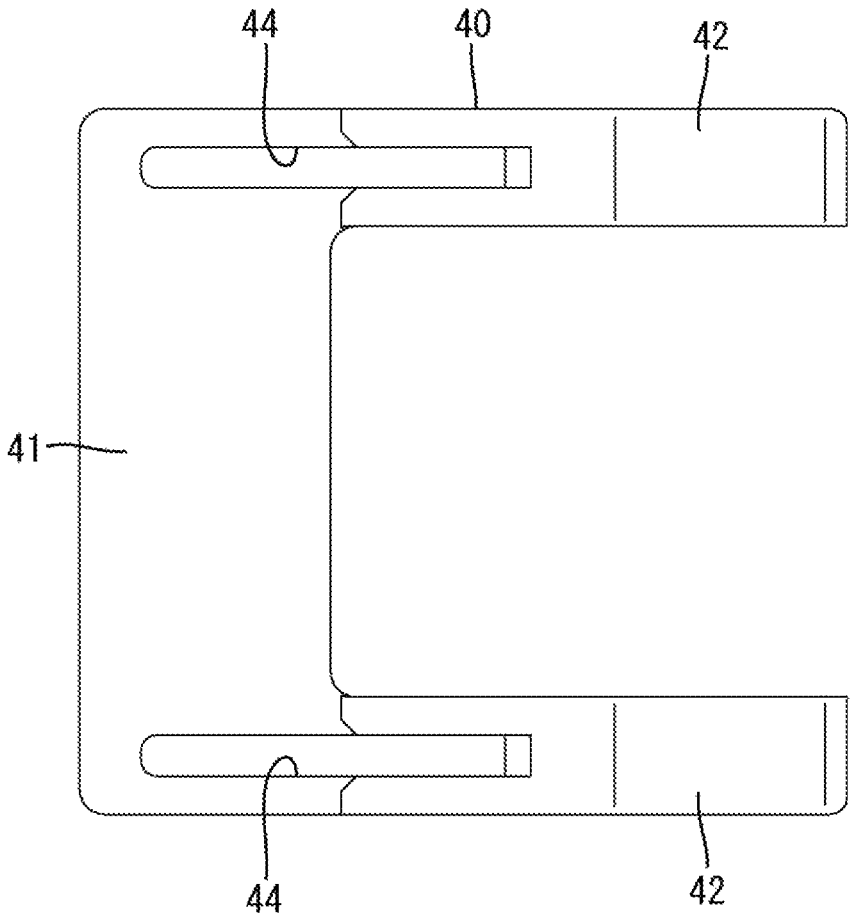
FIG. 11 is a bottom view of the detector.

As shown in FIG. 11, the lower surfaces of the rear parts of the respective arms 42 are recessed to form two guide grooves 44 extending in the front-rear direction. The guide grooves 44 are slit-like in a bottom view and both front and rear ends thereof are closed.

Figure 9:
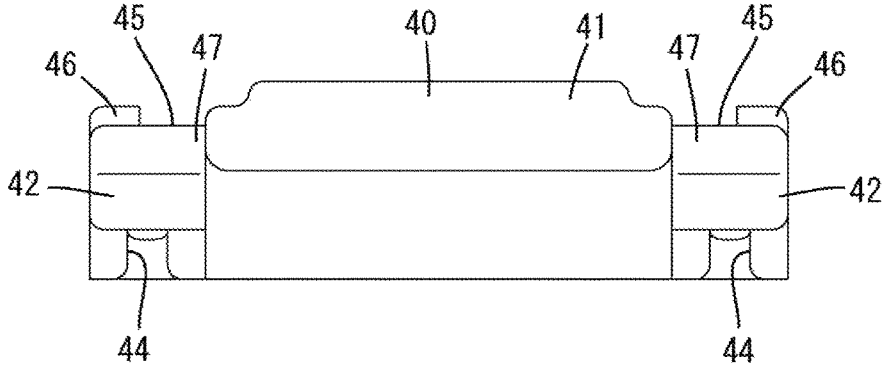
FIG. 9 is a front view of the detector.

As shown in FIGS. 9 and 10, two recesses 45 are provided in the upper surfaces of the respective arms 42 for allowing later-described releasing portions 66 of the lever 60 to escape. Each recess 45 is defined by inner surfaces of both left and right side walls 46 in the upper surface of the rear part of each arm 42. A front part of each arm 42 is thinned gradually toward the front and the upper surface of the front part is formed into a slope inclined down to the front. The bottom surface of each recess 45 is continuous with a slope of the upper surface of the front part without a step.

Two locking portions 47 project up on front end parts of the respective arms 42. As shown in FIG. 4, each locking portion 47 is column having a rectangular cross-section and is lockable to the corresponding stopper 33. The front surface of each locking portion 47 is arranged substantially along the vertical direction to face and contact the stopper 33, and the upper surface of each locking portion 47 is inclined slightly down toward the front so as to be pushed by the releasing portion 66 of the lever 60.

Figure 12:
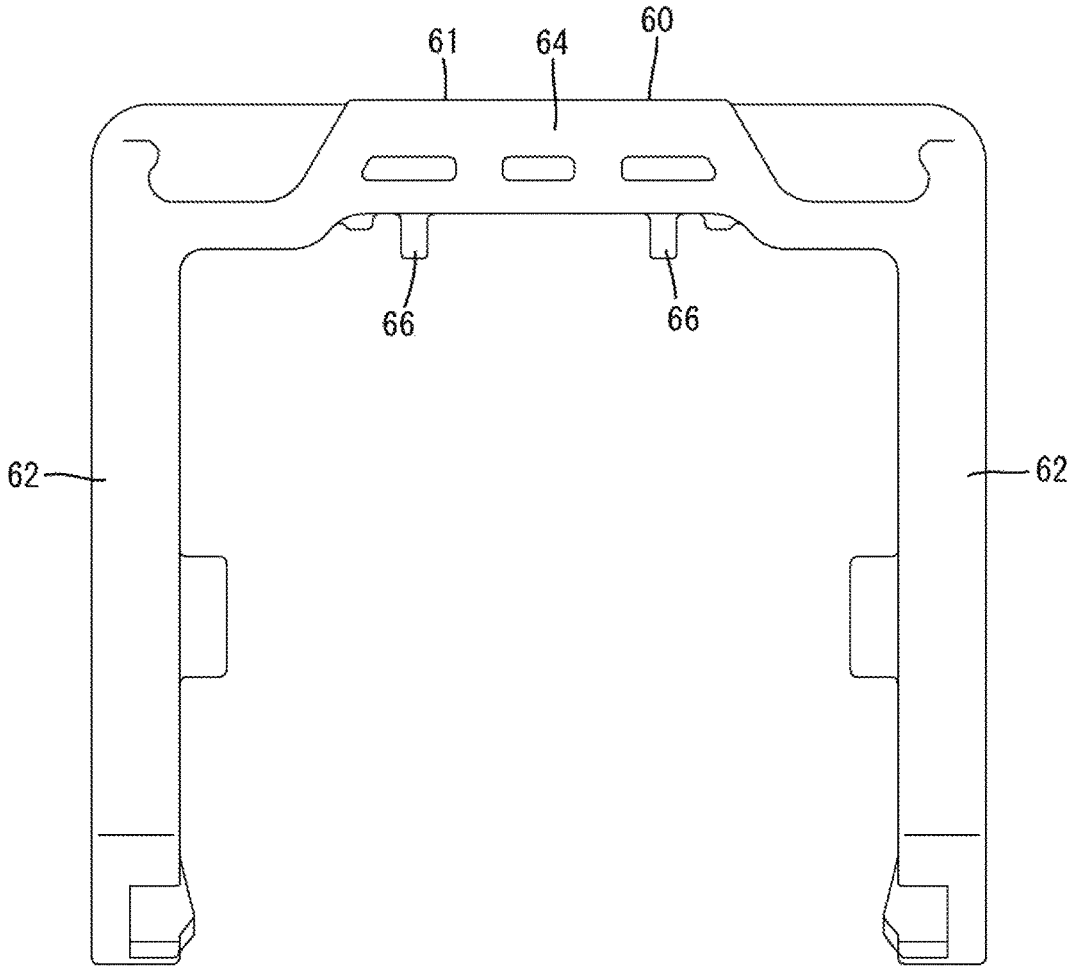
FIG. 12 is a front view of the lever.

The lever 60 is made of synthetic resin and, as shown in FIG. 12, has a lever operating portion 61 that is U-shaped in a plan view and extending along the lateral direction. Cams 62 project down from left and right ends of the lever operating portion 61. Each cam 62 is a plate extending along the vertical direction and includes, as shown in FIG. 2, a bearing 63 for receiving the support shaft 26. The bearing 63 is a hole having a circular cross-section and penetrates through the cam 62 for receiving the support shaft 26. The inner surfaces of the respective cams 62 facing each other are recessed to form unillustrated cam grooves extending in a predetermined direction and open on an outer peripheral edge.

The lever 60 is mounted to straddle the housing 10 and is rotatable about each support shaft 26 between an initial position and a connection position. The lever operating portion 61 is arranged obliquely behind the housing 10 when the lever 60 is at the initial position and an entrance of each cam groove faces forward. The lever operating portion 61 is arranged above the housing 10 when the lever is at the connection position, as shown in FIG. 1.

When the lever 60 is at the initial position, unillustrated cam followers of the mating housing 90 are inserted into the entrances of the respective cam grooves by lightly connecting the mating housing 90 to the housing 10. The lever 60 then is rotated toward the connection position. Thus, the cam followers slide on groove surfaces of the cam grooves to produce a cam action between the lever 60 and the mating housing 90. Thus, the mating housing 90 is pulled toward the housing 10 and a connecting operation of the housings 10, 90 proceeds with a small connection force. The housings 10, 90 are connected properly when the lever 60 reaches the connection position. Accordingly, the terminal fittings are inserted into the cavities 12 of the housing 10 and are connected electrically to the corresponding mating terminal fittings.

Figure 3:
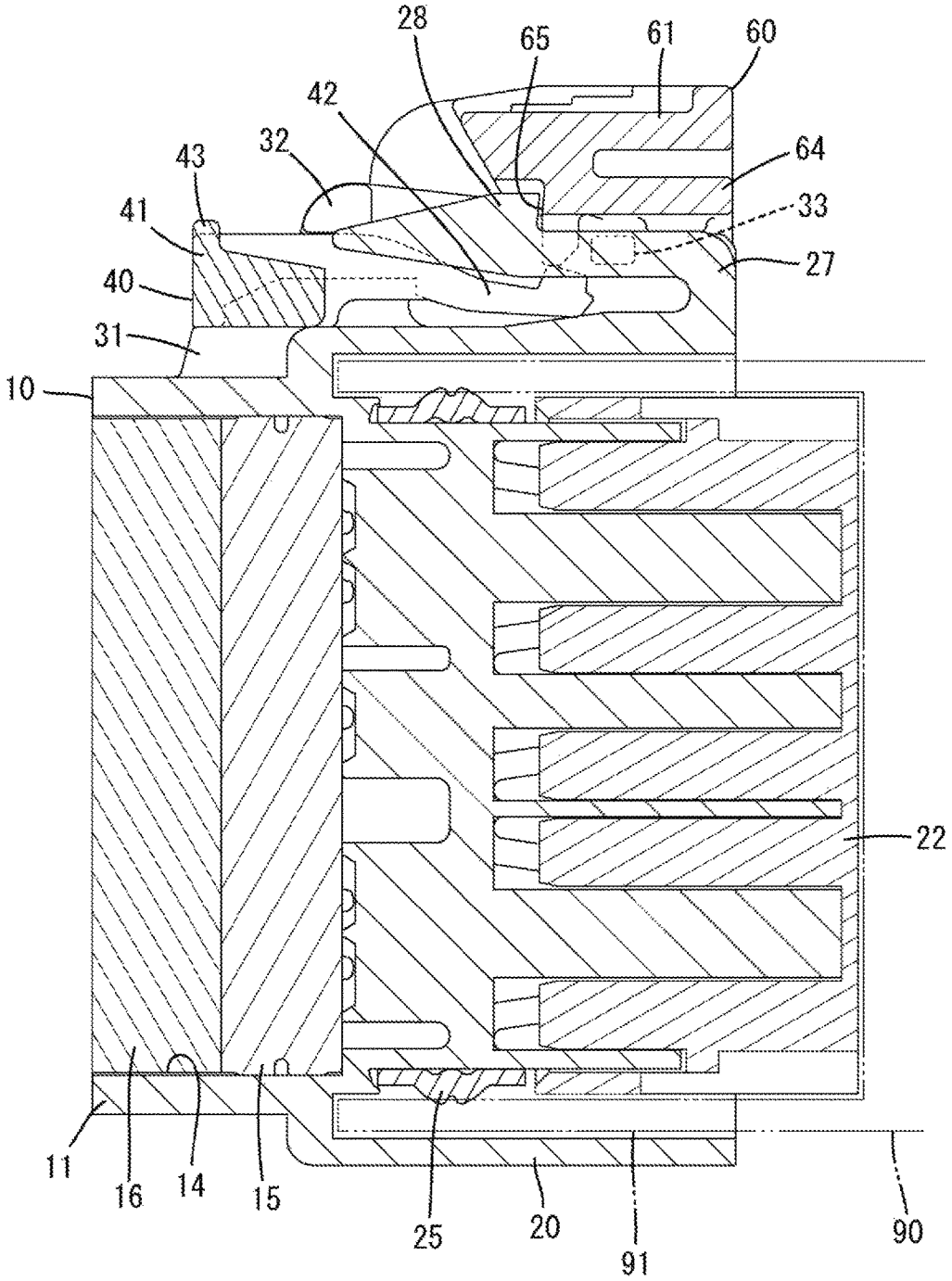
FIG. 3 is a section showing a state where a lock of the lever is locked to a lock arm of a housing.

A laterally central part of the lever operating portion 61 has a lock 64 in the form of a flat plate. As shown in FIG. 3, a lower surface of the lock 64 has a downwardly and rearwardly open lock recess 65 having an L-shaped cross-section. The lock recess 65 includes vertical and horizontal surfaces. The vertical surface can face and contact the front surface of the lock projection 28. The horizontal surface extends along the front-rear direction and can face and contact the upper surface of the lock projection 28.

Two laterally-spaced releasing portions 66 are at positions on the lever operating portion 61 adjacent the lock recess 65 in the lower surface of the lock portion 64, as shown in FIG. 12. Each releasing portion 66 is a column having a rectangular cross-section. A lower part of the front surface of each releasing portion 66 is chamfered to incline down, as shown in FIG. 4 and the lower surface thereof is flat along the front-rear direction. Each releasing portion 66 can release a locked state of each locking portion 47 and each stopper 33 by contacting each locking portion 47 of the detecting member 40 when the lever 60 reaches the connection position.

Next, functions and effects of the lever-type connector are described.

The connecting operation of the housings 10, 90 is started by arranging the detector 40 at the standby position with respect to the housing 10 and arranging the lever 60 at the initial position. A movement of the detector 40 to the detection position is restricted by the contact of the locking portion 47 of each arm 42 with the rear surface of each stopper 33. Further, the upper surface of the rear part of the detector 40 is arranged to contact each restricting portion 32 and the lower surface of the rear part of the detector 40 is supported by each support 31 (see FIGS. 1 and 2). Each guide 30 is fit into the guide groove 44 of each arm 42 and contacts the front surface of the guide groove 44 to restrict a rearward movement of the detector 40 from the standby position (see FIG. 2). In this way, the detector 40 is held at the standby position with respect to the housing 10 with movements thereof restricted.

In the above state, the mating housing 90 is connected lightly to the housing 10 and the lever 60 is rotated toward the connection position by gripping the lever operating portion 61. In the process of rotating the lever 60, the lever operating portion 61 is displaced up from a position behind the lock arm 27. At this time, each releasing portion 66 enters the recess 45 of each arm 42 to avoid interference of the lever 60 with the detector 40.

In the process of rotating the lever 60, the lock 64 slides on the inclined rear surface of the lock projection 28 to deflect and deform the lock arm 27 down. The lock arm 27 resiliently returns when the lever 60 reaches the connection position, and the lock projection 28 fits into the lock recess 65 of the lock 64 to be locked (see FIG. 3) and the lever operating portion 61 is arranged to contact the upper surface of each protection wall 29. In this way, the lever 60 is held at the connection position with rotational displacements restricted.

Further, as the lever 60 reaches the connection position, each releasing portion 66 contacts the locking portion 47 of each arm 42 to press the locking portion 47 so that each arm 42 is deflected and deformed (see FIG. 2). In this way, the locking portion 47 of each arm 42 is separated from each stopper 33, the locked state of each locking portion 47 and each stopper 33 is released and the detector 40 becomes movable to the detection position.

In that state, the operating portion 41 of the detector 40 is pressed forward toward the detection position. In the process of moving the detector 40 to the detection position, each guide 30 slides on the groove surface of each guide groove 44 to guide a movement of the detector 40. Further, the deflected state of each arm 42 is maintained. When each guide 30 is displaced to the rear part of each guide groove 44 and the operating rib 43 reaches a position immediately behind the lock arm 27, each arm 42 resiliently returns and each locking portion 47 is arranged to contact the front surface of each stopper 33 (see FIG. 4). In this way, the detector 40 is held at the detection position with respect to the housing 10 with movements restricted.

On the other hand, the releasing portions 66 cannot reach a position to press the locking portions 47 if the lever 60 does not reach the connection position. Accordingly, the locked state of each locking portion 47 and each stopper 33 is maintained, and a movement of the detector 40 to the detection position is restricted. Thus, the detector 40 can move to the detection position only if the lever 60 reaches the connection position where the housings 10, 90 are connected properly. Therefore, the ability to move the detector 40 to the detection position indicates that the housings 10, 90 have been connected properly.

As described above, the releasing portions 66 of the lever 60 press the locking portions 47 to release the locked state of the locking portions 47 and the stoppers 33. The detector 40 then can move from the standby position to the detection position as the lever 60 is rotated to the connection position. Thus, movement of the detector 40 is linked directly with displacement of the lever 60 to improve detection reliability. Further, the detector 40 is arranged on the housing 10 and is not likely to be contacted by a hand of a worker who is displacing the lever 60. Therefore, movement of the lever 60 will not cause inadvertent movement of the detector 40. Furthermore, the lever 60 is not likely to contact the detector 40 on the housing 10 as the lever 60 is rotated with respect to the housing 10.

The recesses 45 that receive the releasing portions 66 of the lever 60 are provided in the upper surface of the detector 40. Thus, a rotation locus of the lever 60 can be made lower by a depth of the recesses 45 and, eventually, a height reduction of the connector can be realized.

Other embodiments of the invention are described briefly below.

The lever may be a slide lever configured to slide along a wall surface of the housing from the initial position to the connection position.

The stopper of the housing may be deflectable and deformable, and the releasing portion may press the stopper to release the locked state of the stopper and the locking portion when the lever reaches the connection position.

The releasing portion may press the locking portion or the stopper via another structural part to release the locked state of the locking portion and the stopper without directly coming into contact with the locking portion or the stopper.

A spring capable of accumulating a biasing force toward the detection position may be mounted in the detector, and the detector may be biased by the spring to automatically move to the detection position as the lever reaches the connection position and the locked state of the locking portion and the stopper is released.

LIST OF REFERENCE SIGNS

10 . . . housing
33 . . . stopper
40 . . . detector
42 . . . arm
45 . . . recess
47 . . . locking portion
60 . . . lever
66 . . . releasing portion
90 . . . mating housing

What is claimed is:

1. A lever-type connector, comprising:

a housing connectable to a mating housing, the housing having an outer surface, first and second protection walls projecting from the outer surface and extending in front to back directions, the first and second protection walls spaced from each other and arranged substantially parallel to each other, first and second stoppers formed respectively on upper ends of the first and second protection walls and projecting towards each other;

a detector arranged between the first and second protection walls and movable with respect to the housing from a standby position to a detection position, the detector having first and second locking portions for locking the first and second stoppers of the housing at the standby position before the housing is connected properly to the mating housing and restricting a movement to the detection position, a locked state of the first and second locking portions and the first and second stoppers being released to allow movement to the detection position when the housing is connected properly to the mating housing; and a lever arranged displaceably from an initial position to a connection position with respect to the housing, the housing being engaged with the mating housing at the initial position, the housing and the mating housing being connected by a cam mechanism acting between the lever and the mating housing in the process of displacing the lever from the initial position to the connection position; wherein the lever including a releasing portion for releasing the locked state by pressing one of the first and second locking portions when the lever is displaced to the connection position.

2. The lever-type connector of claim 1, wherein the lever is rotatable from the initial position to the connection position about a shaft of the housing.

3. The lever-type connector of claim 2, wherein the detector includes a recess on an outer surface, the releasing portion being inserted into the recess.

* * * * *